US010548402B1

(12) United States Patent
McCants

(10) Patent No.: US 10,548,402 B1
(45) Date of Patent: Feb. 4, 2020

(54) FOLDING CHAIR WITH A SAFETY DEVICE

(71) Applicant: Jacquelyn McCants, Detroit, MI (US)

(72) Inventor: Jacquelyn McCants, Detroit, MI (US)

( * ) Notice: Subject to any disclaimer, the term of this patent is extended or adjusted under 35 U.S.C. 154(b) by 0 days.

(21) Appl. No.: 16/023,869

(22) Filed: Jun. 29, 2018

(51) Int. Cl.
*A47C 7/00* (2006.01)
*A47C 4/00* (2006.01)

(52) U.S. Cl.
CPC ..... *A47C 7/002* (2013.01); *A47C 4/00* (2013.01)

(58) Field of Classification Search
CPC ..... A47C 7/002; A47C 4/00
USPC ..... 297/463.1
See application file for complete search history.

(56) References Cited

U.S. PATENT DOCUMENTS 902,248 A 10/1908 Painter
1,740,214 A 12/1929 Wurdack
1,793,035 A * 2/1931 Whitney ..... A47B 61/003 211/123
2,504,897 A * 4/1950 Stanton ..... A47B 23/02 108/97
2,871,921 A 2/1959 Arnold
2,956,618 A 10/1960 Eames et al.
4,717,201 A 1/1988 Barras
4,826,241 A 5/1989 Barras
5,240,032 A * 8/1993 Mizioch ..... E03B 9/10 137/368
5,377,462 A * 1/1995 Beals ..... E04F 21/0015 269/904
5,707,105 A 1/1998 Liu
6,598,544 B2 7/2003 Laws et al.
7,267,358 B2 11/2007 Chen
7,299,590 B1 * 11/2007 Gibbs ..... E04F 21/0015 248/351
7,328,942 B1 2/2008 Wu
7,874,613 B2 * 1/2011 Tokatlian ..... A47D 1/106 248/351
8,816,199 B1 * 8/2014 French ..... H05K 7/1491 174/59
2010/0171357 A1 * 7/2010 Bonjour ..... A61G 5/10 297/463.1
2013/0113266 A1 * 5/2013 Callahan ..... A47C 7/00 297/463.1
2014/0203619 A1 * 7/2014 Dapra ..... A47C 7/008 297/463.1

FOREIGN PATENT DOCUMENTS

EP 0179409 4/1986

* cited by examiner

*Primary Examiner* — Mark R Wendell
(74) *Attorney, Agent, or Firm* — Suzanne Kikel

(57) ABSTRACT

A safety device for a folding chair has an adjustable brace for attachment to spaced-apart legs of a folding chair for preventing the chair from collapsing under weight. The brace includes two telescopic tubes and a locking mechanism that releasably locks the tubes together in a position that securely interposes the brace between the legs with the brace securely engaged with each leg. The overall length of the brace is adjusted to provide the most stable support to the chair. First and second leg engaging elements have a Y-shape configuration with an open curved portion and an extended leg portion. The open curved portions fit snugly around the chair legs. In a further embodiment, fasteners are provided on opposed ends of the open curved portions and the curve portions are overlapped so as to receive and encircle a chair leg to secure the brace to the folding chair.

9 Claims, 7 Drawing Sheets

FOLDING CHAIR WITH A SAFETY DEVICE

BACKGROUND OF THE INVENTION

1. Field of the Invention

The present invention relates to the general art of folding chairs, and to the particular field of safety devices for a folding chair.

2. Brief Description of the Prior Art

Folding chairs are well known in the art. They typically consist of two sets of legs that are pivotally attached. A seat is also pivotally attached to the legs such that when the legs are separated, the seat is positioned horizontally to the ground for supporting a user. Typically, the back set of legs has a back rest that extends there between. Folding chairs generally have foldable frames designed to compact the size of the chairs for storage. Folding chairs have proven useful for activities, such as, camping, parade watching, and extra seating about the home. They may also be used for public gatherings, such as weddings, political conventions, and the like. When not in use, folding chairs typically are folded and stacked together. The folding chairs can be easily set up in various arrangements in order to meet the seating requirements of the gathering.

Some present-day folding chairs have proven to be less than satisfactory due to their uncomfortable nature when erected. Many chairs have small seats and/or back surfaces, making sitting in them for even short periods of time extremely uncomfortable. The turning and folding function of these types of folding chairs may cause the chairs to accidentally tumble due to the unbalanced loading during use. Hence, safety and stability issues have become very important for these folding chairs. Present-day folding chairs may also be difficult to set up and/or they easily collapse. Some folding chairs may be designed to overcome one or more of these latter disadvantages. However, these folding chairs may tend to fold into unusual shapes, making the chairs difficult to be transported and stored. Additionally, the geometric configurations of some present-day folding chairs may not allow the use of materials of sufficient size and shape so as to prevent slight overloading, unavoidable misuse, and/or wear ultimately resulting in inferior seating characteristics of these chairs.

Light weight folding chairs formed of tubular metal elements, such as aluminum, are currently being manufactured and marketed. Although such chairs may have some desirable characteristics, some difficulty has been encountered in that these chairs may lack stability when erected in seating form.

There is a need in the art to provide a foldable chair which when erected in seating form forms a rigid and stable body support while still maintaining desirable characteristics of seating comfort for the user.

There is a further need in the art to provide a safety device for a folding chair structure for preventing accidental collapsing of the chair.

SUMMARY OF THE INVENTION

The present invention provides such a safety device for a folding chair. The invention provides an adjustable brace that is secured to and attached between two spaced-apart legs of a folding chair to stabilize the legs and to prevent them from collapsing. The brace includes two telescopically interconnected tubes, whereby the overall length of the brace can be adjusted according to the space between the legs. The brace further includes two chair leg engaging elements, each attached to one of the tubes at an opposite end of the brace for releasably attaching the brace to an associated chair leg. A locking mechanism interconnects the two tubes together at a predetermined length depending on the distance or space between the two spaced-apart chair legs.

The inner tube has several spaced-apart apertures, and a locking mechanism for interconnecting the inner and outer tubes together. The locking mechanism includes a fastener, such as a thumb screw, a spring-biased fastener, or similar well-known devices on the outer tube, and the fastener is releasably received in one of the spaced-apart apertures of the inner tube. In a further embodiment of the invention, both the inner and outer tubes have a plurality of space-apart apertures, and the locking mechanism includes fasteners, such as screws, which are secured in an aligned pair of spaced apart apertures of the telescopic tubes.

The chair leg engaging elements have a Y-shape configuration with an open curved portion and an extended leg portion contiguous to the open curved portion. The extended leg portion of a first chair leg engaging element is attached to the inner tube, and the extended leg portion of a second chair leg engaging element is attached to the outer tube. The open curved portion of each chair leg engaging element fits snugly around the chair leg when the brace is positioned between and secured to the spaced-apart legs of the folding chair. Snap fasteners may be provided on the extended leg portions for attaching the chair leg engaging elements to its respective tube, or the leg portions may be fixedly attached by welding or gluing. In this embodiment of the invention, the chair leg engaging elements are made of a substantially rigid material.

In a further embodiment of the invention, the open curved portion of the first and second chair engaging elements has fasteners, such as, hook-and-loop fasteners, on its opposed ends such that the opposed ends are overlapped and secured together for attachment of the first chair leg engaging element and attachment of the second chair leg engaging element to an opposed leg of the two spaced-apart legs of the folding chair for securing the brace of safety device of the invention to the legs of the folding chair.

These and other features and advantages of the present invention will be better appreciated and understood when the following description is read along with the accompanying drawings.

BRIEF DESCRIPTION OF THE DRAWING FIGURES

The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
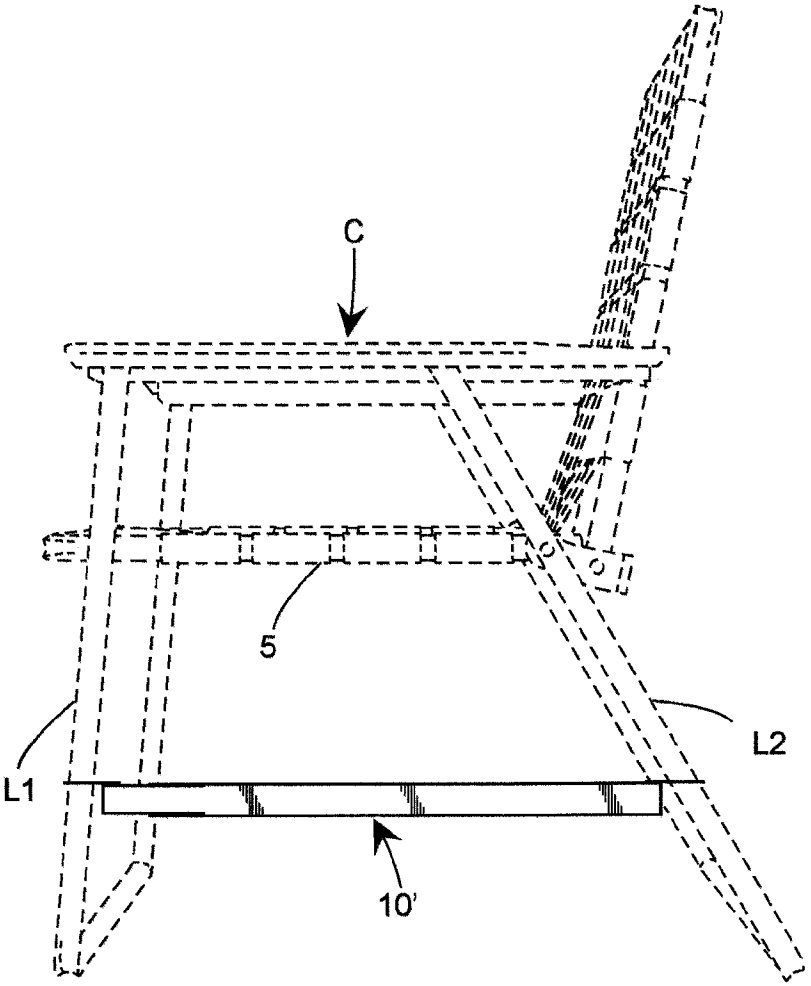
FIG. 1 is a perspective, side view of a folding chair and the safety device of the present invention.
Figure 2:
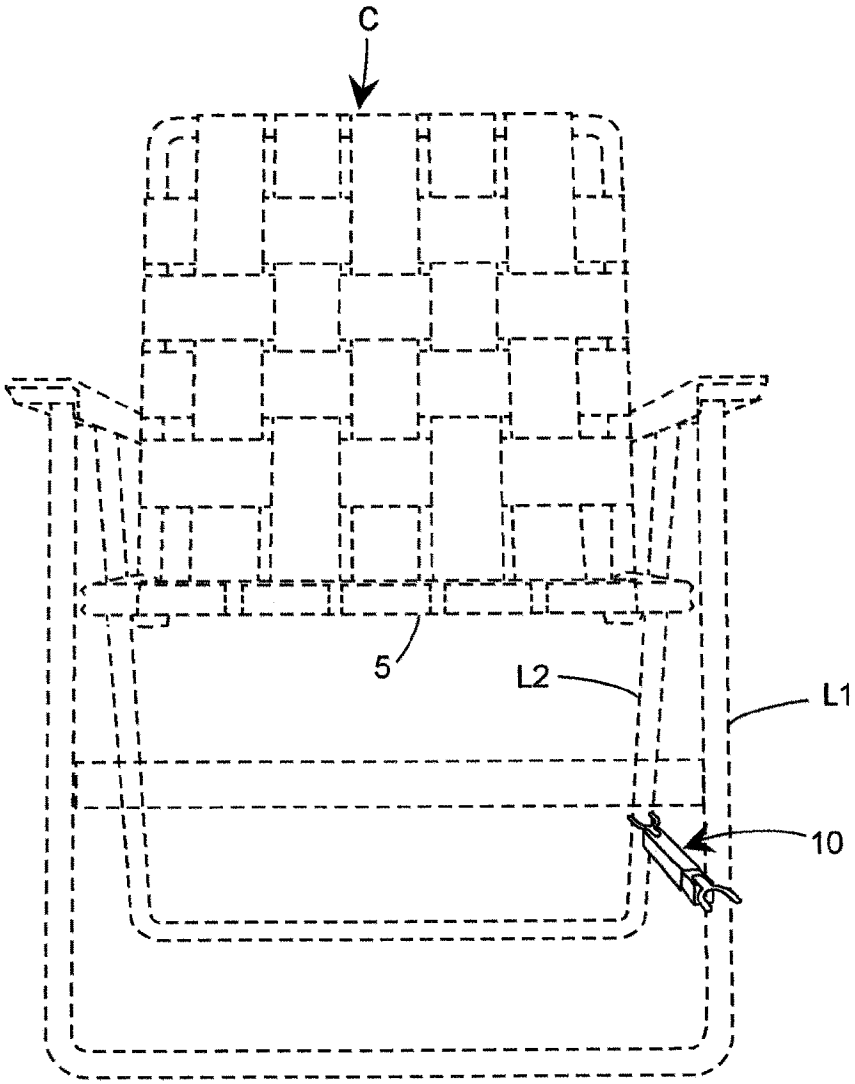
FIG. 2 is a perspective, front view of the folding chair of FIG. 1.

Referring to the figures, it can be understood that the present invention is embodied in a safety device 10 for preventing two legs L1 and L2 of a folding chair C from collapsing toward each other when seat S of folding chair C supports the weight of a user. Legs L1 and L2 may be two spaced-apart side legs as shown in FIG. 1, or two-spaced apart front legs as shown in FIG. 2, or two-spaced apart rear legs.

Figure 3:
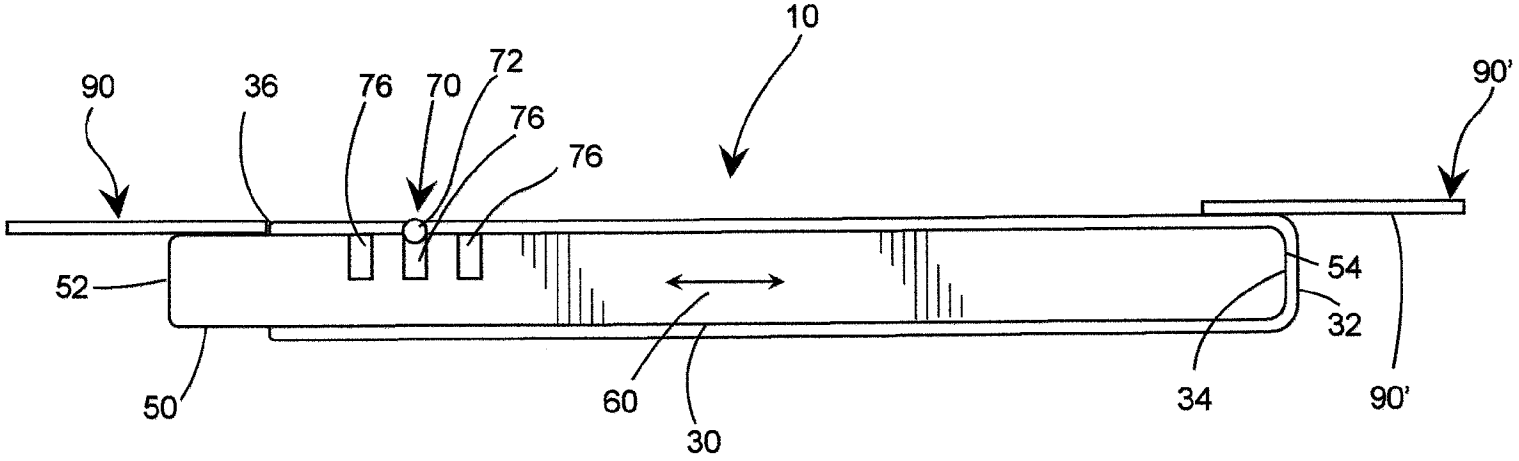
FIG. 3 is a schematic, partly cross-sectional view of the safety device of the invention.

With reference to FIG. 3, the safety device 10 of the invention is an adjustable brace which comprises two telescopically arranged tubes, that is, an outer tube 30 and an inner tube 50. Outer tube 30 has a first end 32 with a blind-ended bore 34, and a second end 36 which is open to receive inner tube 50.

Inner tube 50 is telescopically arranged within outer tube 30. Inner tube 50 has a first end 52 which extends out from outer tube 30, and a second end 54 which is adjacent to the blind-ended bore 34 of outer tube 30. It can be appreciated from FIG. 3 that the longitudinal axis of outer tube 30 extends between its first end 32 and its second end 36, and that the longitudinal axis of inner tube 50 extends between its first end 52 and its second end 54. The longitudinal axis of outer tube 30 and the longitudinal axis of inner tube 50 are in alignment with each other since inner tube 50 is telescopically arranged within outer tube 30. That is, inner tube 50 is constructed and arranged to slide into and out of outer tube 30 along their longitudinal axes, as indicated by the double-headed arrow 60.

As stated herein above, inner tube 50 is slidably arranged in the blind-ended bore 34 of outer tube 30 such that first end 52 of inner tube 50 is located adjacent to and extends out of the first end 36 of outer tube 30, and inner tube 50 is slidably movable relative to outer tube 30 along its longitudinal axis and also along the longitudinal axis of outer tube 30, as indicated in FIG. 3 by the double headed arrow 60.

Still referring to FIG. 3, safety device 10 has a length which can be defined between the first end 52 of inner tube 50 and the first end 32 of outer tube 30. It can be appreciated that the dimension of this length of safety device 10 is varied by moving inner tube 50 along its longitudinal axis in and out of outer tube 30. Inner tube 50 and outer tube 30 are preferably made of substantially rigid material, such as, plastic, light-weight steel, aluminum, or tin.

Referring again to FIG. 3, a locking mechanism 70 is provided and is structured to releasably lock inner tube 50 to outer tube 30 when locking mechanism 70 is in its operative state. Locking mechanism 70 includes a fastener 72 and a plurality of spaced-apart apertures 76 which are defined in inner tube 50. Fastener 72 may be a thumb screw, a spring-biased fastener, or similar well-known devices. Apertures 76 extend along the direction of the longitudinal axis of inner tube 50 and are positioned to accommodate fastener 72 when fastener 72 is aligned with an associated aperture 76 so as to lock inner tube 50 to outer tube 30. Locking mechanism 70 is released by removing fastener 72 out of its associated aperture 76. The operation and construction of locking mechanism 70 is well-known to those skilled in the art.

Figure 4:
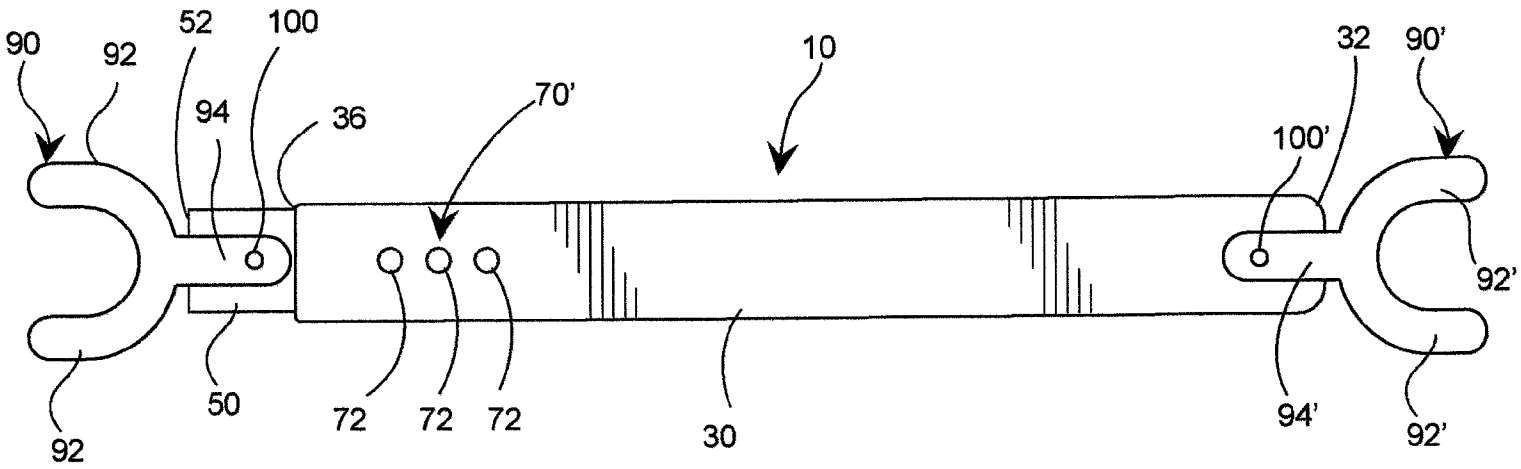
FIG. 4 is a schematic, top plan view of the safety device of the invention.
Figure 5:
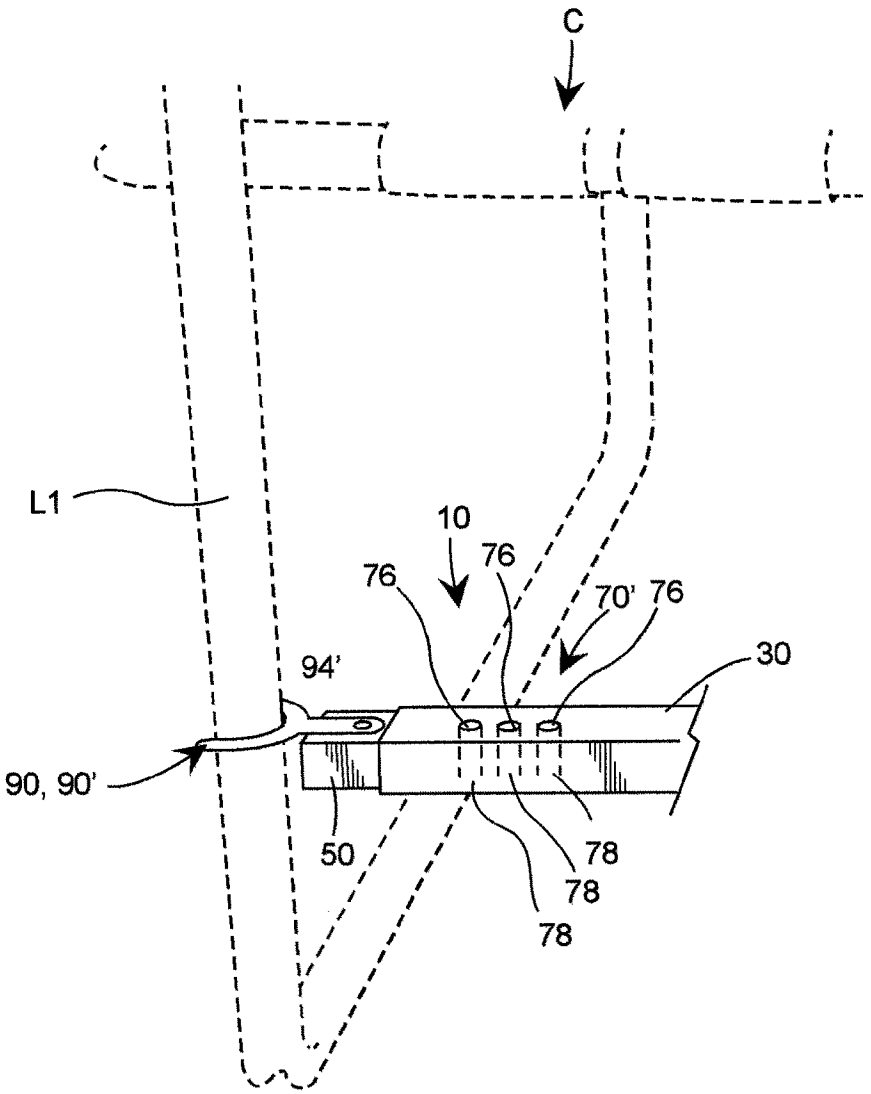
FIG. 5 is a schematic, partly perspective view of the safety device of the invention and its installation on a folding chair.

A second embodiment for a locking mechanism 70' is shown in FIGS. 4 and 5. Similar to the safety device 10 of FIGS. 1 through 3, safety device 10 of FIGS. 4 and 5 comprises an outer tube 30 and inner tube 50. However, the manner in which outer tube 30 and inner tube 50 are interconnected differs from that described herein above for the locking mechanism 70 of the safety device 10 of FIGS. 1 through 3. Locking mechanism 70' comprises a plurality of fasteners, such as screws 72 (FIG. 4), each of which is secured in a respective aperture 78 of a plurality of apertures 78 defined in the wall of inner tube 50 (FIG. 5). Even though not shown, in general, each aperture 78 has internal threads which mate with the external threads of screws 72 so that screws 72 can be secured within an aligned aperture 78 of inner tube 50.

As best shown in FIG. 5, apertures 78 are spaced apart from each other in the direction of the longitudinal axis of inner tube 50. Locking mechanism 70' is further secured to inner tube 50 via spaced-apart apertures 76 along the longitudinal axis of outer tube 30 (FIG. 5). That is, when screws 72 (FIG. 4) are inserted into an aperture 76 of outer tube 30, they will become engaged in an aligned aperture 78 of inner tube 50 such as to lock outer tube 30 and inner tube 50 together. Conversely, when screws 72 are removed from apertures 76 and 78, inner tube 30 can be freely moved with respect to outer tube 50 to adjust the overall length of safety device 10 such that the first and second chair leg engaging elements 90, 90' may engage a respective spaced-apart leg L1, L2 of folding chair C in order to prevent the legs from accidentally collapsing. It is to be appreciated that when safety device 10 is properly positioned between legs L1, L2 of folding chair C, each screw 72 is then secured in its associated aperture 76 of outer tube 30 until its distal end is received in an associated aperture 78 of inner tube 50 so as to lock tubes 30, 50 in a selected position and orientation for a desired length of safety device 10.

Those skilled in the art will appreciate apertures 78 of inner tube 50 may be a dimple, a notch, a hole, or the like, and shaped and sized to adequately accommodate and secure the distal end of screws 72 for interlocking outer tube 30 with inner tube 50. It is also apparent that safety device 10 can be shortened, that is, inner tube 50 can be pushed into outer tube 30 so that it can be removed from between and/or inserted in between legs L1, L2 of folding chair C.

Figure 6:
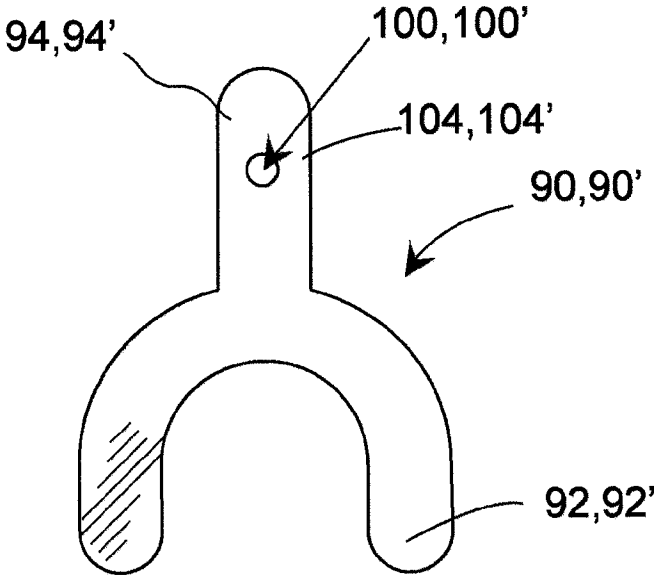
FIG. 6 is a schematic top plan view of a first embodiment of a chair leg engaging element of the safety device of the present invention.

FIG. 6 illustrates a chair leg engaging element 90, 90' for attaching safety device 10 of FIGS. 3 and 4 to a leg L1, L2 of folding chair C. Chair leg engaging element 90, 90' essentially is in a Y-shape configuration, and comprises an open curved portion 92 for engaging the leg of the folding chair, and an extended leg portion 94. As best shown in FIG. 4, chair leg engaging element 90 is mounted to the first end 52 of inner tube 50. Chair leg engaging element 90 is fixedly attached to inner tube 50 via suitable means, such as an adhesive, for example, glue, welding, or it may be releasably mounted to inner tube by fastener 100, as shown on extended leg portion 94 of element 90 in FIG. 4. Snap fastener 100, in general, includes a first snap element (not shown), which preferably is mounted on inner tube 50, and a corresponding snap receiving element 104 on extended leg portion 94 of chair leg engaging element 90. Snap fastener 100 is a device well-known in the art. Chair leg engaging element 90, preferably, is relatively rigid and such that open curved portion 92 fits snugly around the leg L1 (FIG. 1) of folding chair C (FIG. 1) while the extended leg portion 94 of element 90 remains fixedly attached to inner tube 50.

Again with reference to FIG. 4, a second chair leg engaging element 90' is provided for attaching safety device 10 to a second leg of a folding chair, which leg is spaced-apart from the first leg. Second chair leg engaging element 90' is essentially in a Y-shape configuration, and comprises an open curved portion 92' for engaging an opposite leg of folding chair C and extended leg portion 94', which as shown in FIG. 4, is mounted to the second end 32 of outer tube 30. Second chair leg engaging element 90' is fixedly attached to outer tube 30 via suitable means, such as an adhesive, for example, glue, or it may be releasably mounted to outer tube 30 via a snap fastener 100', as shown on extended leg portion 94' of second chair leg engaging element 90' in FIG. 4. Snap fastener 100', in general, includes a first snap element (not shown), which preferably is mounted on outer tube 30, and a corresponding snap receiving element 104' on extended leg portion 94' of second chair leg engaging element 90'. Snap fastener 100' is a device well-known in the art. Second chair leg engaging element 90', preferably, is relatively rigid and such that its open curved portion 92' fits snugly around leg L2 (FIG. 1) of folding chair C (FIG. 1) while its extended leg portion 94' remains fixedly attached to outer tube 30.

From the preceding paragraph, it is apparent that inner tube 50 includes a first chair leg engaging element 90; that outer tube 30 includes a second leg engaging element 90'; and that both the first and second chair leg engaging elements 90, 90' comprise an open curved portion 92, 92' for engaging a leg L1, L2 of folding chair C while the extended leg portion 94 of the first leg engaging element 90 is mounted to inner tube 50 and the extended leg portion 94' of the second leg engaging element 90' is mounted to outer tube 30 for securing safety device 10 between two spaced-apart legs of a folding chair for preventing the folding chair from accidentally collapsing. The manner in which the first and second leg engaging elements 90, 90' engage a leg of a folding chair is best shown in FIG. 1 and to the left of FIG. 2.

Figure 7:
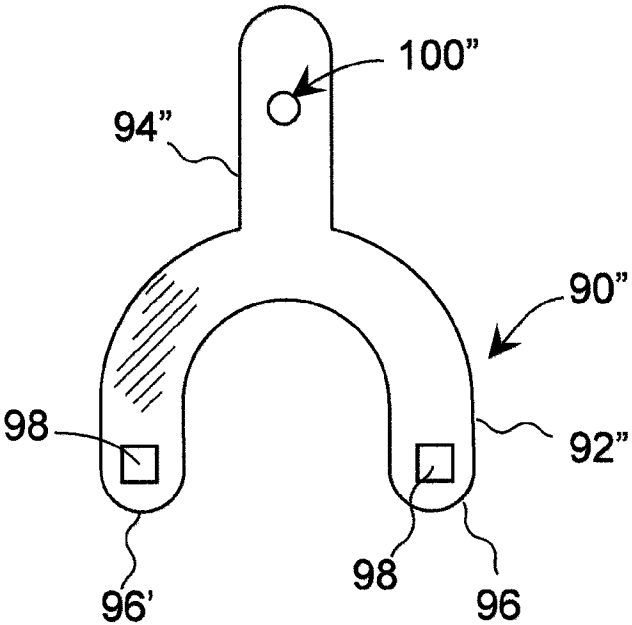
FIG. 7 is a schematic top plan view of a second embodiment of a chair leg engaging element of the safety device of the present invention.

A second embodiment for a chair leg engaging element 90" is illustrated in FIG. 7. Similar to chair engaging element 90, 90' of FIG. 6, this second embodiment for a chair leg engaging element 90" attaches to the opposite ends of safety device 10 to a chair leg L1, L2 of folding chair C. This chair leg engaging element 90" of FIG. 7 may be used with safety device 10 of FIGS. 1-5. Chair leg engaging element 90" of FIG. 7 is similar to first and second chair leg engaging elements 90, 90' of FIG. 6. That is, chair leg engaging element 90" of FIG. 7 is in a Y-shape configuration and comprises an open curved portion 92" and an extended leg portion 94". In this embodiment, open curved portion 92" of chair leg engaging element 90" is preferably encircled around a chair leg L1, L2 with ends 96, 96' of open curved portion 92" overlapped and then fastened in a closed position by a fastener, such as a hook-and-loop fastener 98 on ends 96, 96; of chair leg engaging element 90".

In FIG. 7, a hook-and-loop fastener 98 is on the top surfaces of chair leg engaging element 90"; however, it is to be appreciated that a corresponding hook-and-loop fastener may be provided on an undersurface of end 96' of FIG. 7. Also, as an alternate manner in installing chair leg engaging element 90" around chair leg L1, L2, the two opposite ends 96, 96' of open curved portion 92" may be connected together as a unit and then chair leg L1, L2 may be inserted into chair leg engaging element 90". A first chair leg engaging element 90" is attached to outer tube 30, and a second chair leg engaging element 90" is attached to the inner tube 50 in a manner similar to that described herein above with reference to chair leg engaging element 90, 90' of FIG. 6. Similar to chair leg engaging element 90, 90', chair leg engaging element 90" of FIG. 7 may be attached to the tubes 30, 50 via a snap fastener 100 or may be permanently attached to its associated tube through suitable means. Chair leg engaging element 90" may be made of a relatively flexible material, such as, for example, nylon, cloth, and light-weight plastic, so that ends 96, 96' may be easily overlapped and fastened together so as to encircle a leg of the folding chair when safety device 10 is secured between and to the spaced-apart legs L1, L2 of folding chair C.

From the above teachings, it can be appreciated that the distance between the outer ends of the chair leg engaging elements 90, 90', 90" attached to the ends of safety device 10 is easily varied when inner tube 50 is moved longitudinally within outer tube 30, such that the overall length of safety device 10 is changed to accommodate the distance between two spaced-apart legs L1, L2 of a folding chair.

The safety device 10 embodying the present invention is easy to install and remove, and once it is in its operative position, safety device 10 securely holds the chair legs L1, L2 in a spaced apart position to securely support the folding chair C without the legs L1, L2 collapsing toward each other, even if a heavy weight is applied and/or is being supported by the chair. The easy installation and removal of safety device 10 in connection with its adjustability makes it versatile, and its versatility makes safety device 10 economical in that the same device can be installed in many different types of folding chairs and it is easily removed and stored.

While the present invention has been described in connection with the preferred embodiments of the various figures, it is to be understood that other similar embodiments may be used or modifications and additions may be made to the described embodiments for performing the same function of the present invention without deviating there from. Accordingly, it is intended by the appended claims to cover all such changes and modifications as come within the spirit and scope of the invention.

What is claimed is:

1. A folding chair having at least two opposing spaced apart legs and a safety device positioned between the two opposing spaced apart legs safety device for maintaining the spaced apart legs of the folding chair in a predetermined spaced apart position, the safety device comprising:

a) a brace, comprising:

an outer tube having a first end with a blind-ended bore defined therein and a second end and a longitudinal axis extending between the first end and the second end;

an inner tube telescopically extending within and out of the outer tube, and having a first end and a second end and a longitudinal axis extending between the first end and the second end of the inner tube, the inner tube being constructed to slide within the outer tube in the of the longitudinal axis of the outer tube and the longitudinal axis of the inner tube to accommodate and occupy the space between the two opposing spaced apart legs of the folding chair;

the brace having a length dimension defined between the first end of the inner tube and the second end of the outer tube and being varied by moving the inner tube and the outer tube relative to each other in the direction of the longitudinal axis of the inner tube and the longitudinal axis of the outer tube;

b) a locking mechanism for locking the inner tube and the outer tube together;

c) a first chair leg engaging element in a Y-shape configuration and having an inner continuous U-shape open curved portion for engaging a first chair leg when the brace is in use and an extended leg portion attached to the inner tube adjacent to the first end of the inner tube; and d) a second chair leg engaging element in a Y-shape configuration and having an inner continuous U-shape open curved portion for engaging a second chair leg when the brace is in use and an extended leg portion attached to the outer tube adjacent to the second end of the outer tube;

the distance between the first chair leg engaging element and the second chair leg engaging element being varied as the inner tube and the outer tube are moved relative to each other such that the overall length of the brace changes to accommodate and occupy the distance between the two opposing spaced apart legs of the folding chair for maintaining the two opposing spaced apart legs of the folding chair in a predetermined position.

2. The folding chair of claim 1, wherein the inner tube has a plurality of spaced-apart apertures and wherein the locking mechanism includes a fastener mounted on the outer tube and being releasably received in one of the spaced-apart apertures of the inner tube.

3. The folding chair of claim 1, wherein the inner tube has a plurality of spaced-apart apertures and the outer tube has a plurality of spaced-apart apertures; and wherein the locking mechanism includes a plurality of fasteners secured in an aligned pair of spaced apart apertures in the inner tube and outer tube.

4. The folding chair of claim 3, wherein the plurality of fasteners is comprised of a plurality of screws.

5. The folding chair of claim 1, wherein the outer tube and the inner tube are comprised of a substantially rigid material.

6. The folding chair of claim 1, wherein the first chair leg engaging element and the second leg engaging element are comprised of a substantially rigid material, and wherein the inner continuous U-shape open curved portion of the first chair leg engaging element fits snugly around the first chair leg of the folding chair, and the inner continuous U-shape open curved portion of the second chair leg engaging element fits snugly around the second chair leg of the folding chair for securely positioning the safety device between the two opposing spaced apart legs of the folding chair.

7. The folding chair of claim 1, further comprising a first snap fastener for attaching the first chair leg engaging element to the inner tube, and a second snap fastener for attaching the second chair leg engaging element to the outer tube.

8. The folding chair of claim 1, wherein the inner continuous U-shape open curved portion of the first chair leg engaging element has fasteners on its opposed ends, and wherein the inner continuous U-shape open curved portion of the second chair leg engaging element has fasteners on its opposed ends, and wherein the opposed ends of the first chair leg engaging element and the opposed ends of the second chair leg engaging element are overlapped and secured together for attachment of the first chair leg engaging element and attachment of the second chair leg engaging element to a leg of the two opposing spaced apart legs of the folding chair for maintaining the two opposing spaced apart legs of the folding chair in a predetermined position.

9. The folding chair of claim 8, wherein the first chair leg engaging element and the second leg engaging element are comprised of a substantially flexible material capable of being wrapped around its respective chair leg for securing the safety device onto the first chair leg and the second chair leg and between the two opposing spaced apart legs of the folding chair, and wherein the fasteners on the opposed ends of the first chair leg engaging element and the fasteners of the second chair leg engaging element are hook and loop fasteners.

* * * * *